United States Patent [19]

Deering

[11] 4,448,668

[45] May 15, 1984

[54] PROCESS FOR RETORTING OIL SHALE WITH MAXIMUM HEAT RECOVERY

[75] Inventor: Roland F. Deering, Brea, Calif.

[73] Assignee: Union Oil Company of California, Los Angeles, Calif.

[21] Appl. No.: 451,602

[22] Filed: Dec. 20, 1982

[51] Int. Cl.[3] ..... C10B 47/00; C10G 1/02

[52] U.S. Cl. ..... 208/11 R; 208/8 R; 201/16

[58] Field of Search ..... 208/11 R, 8 R; 201/16, 201/31

[56] References Cited

U.S. PATENT DOCUMENTS

| | | | |
|---|---|---|---|
| 2,432,135 | 12/1947 | Barr | 208/11 R |
| 2,550,432 | 4/1951 | Thompson | 202/14 |
| 2,639,263 | 5/1953 | Leffer | 201/16 |
| 2,689,787 | 9/1954 | Ogorzaly et al. | 208/11 R |
| 2,783,898 | 3/1957 | Ardern et al. . | |
| 2,966,446 | 12/1960 | Deering . | |
| 3,004,898 | 10/1961 | Deering . | |
| 3,361,644 | 1/1968 | Deering . | |
| 3,501,394 | 3/1970 | Lyons . | |
| 3,644,193 | 2/1972 | Weggel et al. | 208/11 R |
| 4,003,797 | 1/1977 | Cheadle et al. . | |
| 4,004,982 | 1/1977 | Jennings et al. . | |
| 4,010,092 | 3/1977 | Deering . | |
| 4,069,132 | 1/1978 | Deering | 208/11 R |
| 4,083,770 | 4/1978 | Deering . | |
| 4,273,617 | 6/1981 | Goedde et al. . | |
| 4,288,294 | 9/1981 | Velling . | |
| 4,312,740 | 1/1982 | Chiaramonte . | |
| 4,319,982 | 3/1982 | Meisenburg et al. | 208/11 R |
| 4,336,126 | 6/1982 | Bertelsen . | |
| 4,336,127 | 6/1982 | Bertelsen . | |

OTHER PUBLICATIONS

"Premium Syncrude from Oil Shale Using Union Oil Technology", by Miller, Harvey and Hunter, prepared for the 1982 National Petroleum Refiners Association Annual Meeting held Mar. 21 to 23, 1982, at San Antonio, Texas.

"Synthetic Crude Oil and Transportation Fuels from Oil Shale", by Randle and Kelley, prepared for the 46th Midyear Meeting of the American Petroleum Institute's Refining Department, held May 11 to 14, 1981, in Chicago, Illinois.

*Primary Examiner*—Patrick Garvin
*Assistant Examiner*—Lance Johnson
*Attorney, Agent, or Firm*—Dean Sandford; Gregory F. Wirzbicki

[57] ABSTRACT

Crushed, retorted shale particles recovered from a shale oil retort but still containing combustible materials are burned under oxidizing conditions in a fluidized combustor to remove substantially all of the hydrocarbonaceous materials. Hot combustion flue gases are recovered, divided, and delivered to two heat exchangers, the first for indirectly preheating recycled retort education gases and the second for indirectly heating water. Also recovered from the combustor are shale particles, which are introduced into a fluidized cooling vessel and therein cooled by indirectly exchanging heat with water while traces of residual hydrocarbons burn from the shale.

28 Claims, 2 Drawing Figures

ROLAND F. DEERING -- A PROCESS FOR RETORTING OIL SHALE WITH MAXIMUM HEAT RECOVERY

PROCESS FOR RETORTING OIL SHALE WITH MAXIMUM HEAT RECOVERY

BACKGROUND OF THE INVENTION

This invention relates to retorting processes for recovering product hydrocarbons from oil shale and other hydrocarbon-bearing solids. The invention most particularly relates to those oil shale retorting processes wherein coke on the retorted shale is combusted to provide heat energy.

Many methods for recovering oil from oil shale have been proposed, nearly all of which utilize some method of pyrolytic eduction commonly known as retorting. To be competitive with the production of oils from petroleum stocks, the principal difficulty to be overcome has been recovering essentially all heat value from carbonaceous material in the shale without incurring prohibitive expense or environmental damage. Since shale usually contains only about 20 to 80 gallons of oil per ton, only a limited proportion of which can be recovered as product oil or gas, economical retorting must utilize remaining heat energy contained in the shale to provide heat for pyrolitic eduction. However, sulfur emissions in flue gases released from the retorting process must be restricted to the low levels required by law while this goal is being attained.

It is known to retort oil shale by a technique of contacting up-flowing oilbearing solids with down-flowing gases in a vertical retort, and one such technique is disclosed in U.S. Pat. No. 3,361,644. To educe product vapors, the upward-moving bed of shale particles exchanges heat with a down-flowing, hydrocarbonaceous and oxygen-free eduction gas of high specific heat introduced into the top of the retort at about 950° to 1200° F. In the upper portion of the retort, the hot eduction gas educes hydrogen and hydrocarbonaceous vapors from the shale and, in the lower portion, preheats the ascending bed of particles to retorting temperatures. As preheating continues, the eduction gas steadily drops in temperature, condensing high boiling hydrocarbonaceous vapors into a raw shale oil product while leaving a product gas of relatively high BTU content. The shale oil and product gas are then separated, and a portion of the product gas, after being heated, is recycled to the top of the retort as the eduction gas.

To minimize the volume of the recycle gas required, up-flow retorting is usually conducted with superatmospheric pressures, with the pressure in the upper regions of the retort often being between 10 and 50 p.s.i.g. However, means must be provided for introducing and recovering granular shale from the superatmospheric retorting zone without allowing valuable product and recycle gases to depressure. Conventional methods for achieving these objectives use elaborate lock vessels, valves, star feeders, or slide valves, which tend to wear rapidly and produce excessive fines through abrading the shale. Alternatively liquid sealing devices, as in U.S. Pat. No. 4,004,982 have been employed, which operate by moving shale particles through a standing head of oil or water, thereby creating a positive back pressure to forestall escape of retort gases. Liquid seals effectively contain retort gases but leave the shale wet. When incorporated into a process for combusting retorted shale in a vessel separate from the retort, as is conventional, use of liquid seals requires the expense of drying the shale prior to combustion.

To increase product yield beyond what can be educed in the retort alone, processes have been developed to generate product gases by reaction of hot, retorted shale with an oxidizing gas stream, for example, as taught in U.S. Pat. No. 4,010,092. However, such gasification reactions conducted in an oxidizing environment burn the coke on retorted shale at temperatures high enough to release significant amounts of $CO_2$ from decomposing carbonates in the shale, thereby necessitating expensive removal of $CO_2$ from combustible product gases.

Retorted shale contains heat value in the form of coke, and many retorting processes pass retorted shale particulates through a combustion zone to combust the coke and thus recover heat energy. However, because retorted shale generally contains sulfur components, less than complete combustion of the coke generates $H_2S$, which must be removed from flue gases by means of costly sulfur recovery processes. On the other hand, complete combustion may result in flue gases containing unacceptable amounts of $SO_2$. To solve the problem of $SO_2$ production during complete combustion, U.S. Pat. No. 4,069,132 discloses a combustion process wherein the $SO_2$ generated during the combustion of coke on the retorted shale is converted to stable inorganic salts by reaction with alkaline ingredients of the shale. This process utilizes a combustor through which hot retorted shale gravitates cocurrently with air for combustion diluted by sufficient flue gas to control peak combustion temperature below 1670° F. Under such conditions, the discharge of $SO_2$ from the combustor is disclosed to be greatly minimized.

Because flue gases from combustion zones associated with shale retorts are usually at high temperature, many retorting processes recover heat therefrom. For example, as taught in U.S. Pat. No. 4,069,132, the hot flue gases may be utilized to exchange heat indirectly with boiler feedwater to generate process steam.

While the aforementioned features have met with some success, the need exists for further developments in shale retorting processes or, for example, in the recovery of heat energy from the combustible material in retorted shale.

Accordingly, the principal object of this invention is to provide a highly efficient process for recovering heat from retorted shale particles burned in a fluidized combustor.

Other objects and advantages of the invention will be apparent from the following description taken in conjunction with the appended drawing.

SUMMARY OF THE INVENTION

The present invention provides a heat recovery process of primary usefulness in recovering heat energy from the combustible materials in crushed, retorted shale particles. In this process, the combustible materials in crushed, retorted shale particles are burned under oxidizing conditions in a fluidized bed combustor. The resulting combustion flue gases are recovered, divided, and delivered to two heat exchangers, the first for indirectly preheating recycled retort eduction gases and the second for indirectly heating water. Meanwhile, shale particles recovered from the combustor pass into a fluidized cooling vessel and are therein cooled by heat exchange with water, usually with traces of residual hydrocarbons being burned from the shale.

In one embodiment of this invention, residual heat contained in the flue gases after passage through the two exchangers is transferred by indirect heat exchange to the fluidizing gas stream entering the combustor. In yet another embodiment, combustion flue gases are limited to low concentrations of $SO_2$ by controlling the temperature in the combustor.

DETAILED DESCRIPTION OF THE INVENTION

Any of a large number of naturally occurring oil-producing solids, and particularly those known as oil shale, may be used as feed materials in this process. The characteristics of these materials are generally well known and hence need not be described in detail. For practical purposes, however, the raw shale should contain at least about 10, preferably at least 20, and usually between about 20 and about 80 gallons of oil per ton of raw shale by Fischer assay. The shale should be crushed to produce a raw shale feed having no particles greater than 6 inches and preferably none greater than 3 inches mean diameter. Average particle sizes of ⅛-inch to about 2 inches mean diameter are preferred.

Figure 1:
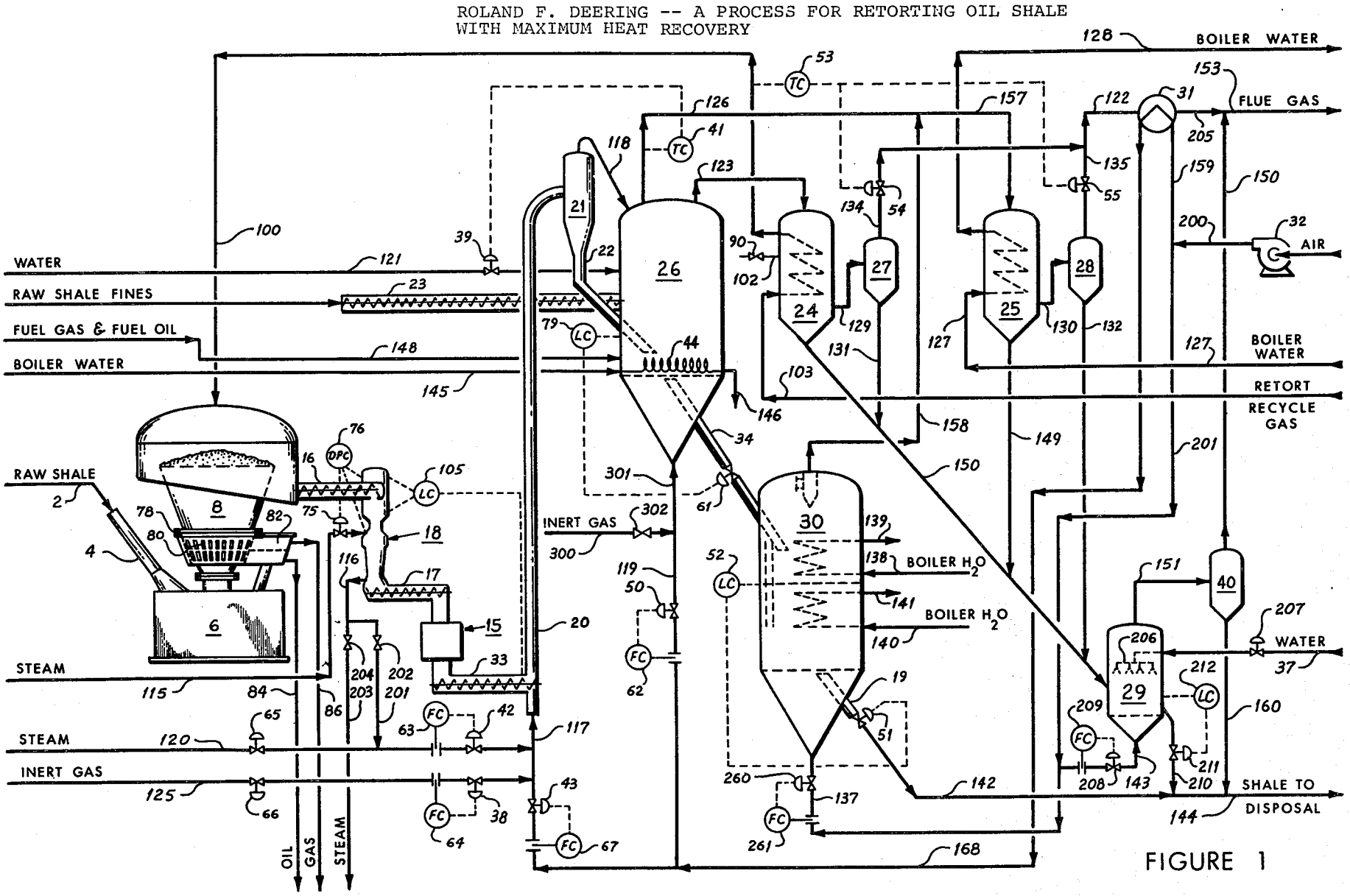
In FIG. 1 is shown a process flowsheet of the process of the invention, including the preferred embodiment thereof. It will be understood, however, that for the sake of simplicity, and in keeping with the usual purpose of a flowsheet, a number of conventional items, such as pumps, compressors, and other equipment which themselves form no part of the invention nor aid in its description have been omitted.

Referring now to FIG. 1, raw crushed oil shale is fed at 2 into hopper 4 associated with a shale feeder within retort housing 6. The shale feeder forces the shale particulates upwardly into retort 8 at a rate which will vary considerably depending upon the size of the retort, the desired holding time therein, and the feeder selected for use. The shale feeder may be of any suitable design, for example, as shown in U.S. Pat. No. 3,361,644 herein incorporated by reference in its entirety. Preferably, however, the shale feeder is of a design such as that shown in U.S. patent application Ser. No. 194,133 filed on Oct. 6, 1980 by Svaboda et al., herein incorporated by reference in its entirety.

Retorting is accomplished in retort 8 in a manner similar to that described in U.S. Pat. No. 3,361,644. The raw shale passes upwardly through retort 8, traversing a lower preheating zone and an upper retorting (or pyrolysis) zone. Temperatures in the lower portion of the retort are sufficiently low to condense product oil vapors from the superjacent retorting zone. As the shale progresses upwardly through the retort, its temperature is gradually increased to retorting levels by countercurrently flowing eduction gases comprising a preheated recycle portion of retort product gas from line 100. This product gas, and hence also the recycle gas, are of high BTU content, generally between about 700 and 1000 BTU/$Ft^3$, and also of high specific heat, usually between about 14 and 18 BTU/mole/°F. Eduction temperatures are conventional, usually in excess of about 600° F., and preferably between 900° and about 1200° F. Essentially all of the oil will have been educed from the shale by the time it reaches a temperature of about 900° F. Gas temperatures above about 1300° F. in the eduction zone should not be exceeded since excessive shale oil cracking will result. Other retorting conditions include shale residence times in excess of about 10 minutes, usually about 30 minutes to about one hour, sufficient to educe the desired amount of oil at the selected retort temperatures. Shale feed rates usually exceed about 100, and are preferably between about 400 and about 2,000 pounds per hour per square foot of cross-sectional area in the retort. These values refer to average cross-sectional areas in the tapered retort illustrated in the drawing.

Pressure in retort 8 may be either subatmospheric, atmospheric, or superatmospheric, but normally the retorting pressure exceeds about 0.3 p.s.i.a., usually about 5 to 100 p.s.i.a., preferably about 25 to about 65 p.s.i.a., and typically about 25 p.s.i.a. The recycle gas is introduced via line 100 at a temperature and flow rate sufficient to heat the crushed shale to retorting temperatures. Heat transfer rates depend in large part on the flow rate, temperature, and heat capacity of this recycle gas. Flow rates of at least about 3,000, generally at least about 8,000, preferably between about 10,000 and about 20,000, and typically about 14,000 SCF of recycle gas per ton of raw shale feed are employed. The temperature differential between the recycle gas and solids at the top of the retorting zone is usually between 10° and 100° F. Excessive temperature differentials, e.g., in excess of about 400° F., should be avoided to prevent thermal stress in the metal of the retort.

As the recycle gas from line 100 passes downwardly through retort 8, it continuously exchanges heat with the upwardly moving oil shale. In the upper portion of retort 8, hydrocarbon materials contained within the oil shale are educed therefrom by pyrolysis, producing shale oil vapors and fuel gases comprising such normally uncondensable gases as methane, hydrogen, ethane, etc. These shale oil vapors and fuel gases pass downwardly with the recycle gas, firstly into the lower portion of retort 8 wherein the cool oil shale condenses the shale oil vapors, and thence into a frustoconical product disengagement zone 78. This disengagement zone comprises peripheral slots 80 through which liquid shale oil and product vapors flow into surrounding product collection tank 82. The liquid shale oil is withdrawn therefrom, usually at a rate between about 5 and 60 gallons/ton of raw shale feed via conduit 84, while the aforementioned product vapors at a temperature between about 80° and 300° F. are withdrawn via conduit 86.

After retorting, the shale particles, now at an elevated temperature, e.g., between about 900° and 1000° F., are removed from the upper portion of retort 8 where the prevailing pressure is generally superatmospheric, as for example at pressures between about 10 and 50 p.s.i.g. The shale particles are withdrawn from the retort by a screw conveyor within conduit 16 and transported successively through sealing leg 18, crusher 15, gas lift 20, and cyclone separator 21, and thence into combustor 26. In FIG. 1, the sealing leg is shown as a single vessel, but in actual practice one or more sealing legs may be employed, operating in parallel with individual crushers, gas lifts, and cyclone separators. In the usual instance, between one and five sealing legs are employed, and in the preferred embodiment, two are employed.

Figure 2:
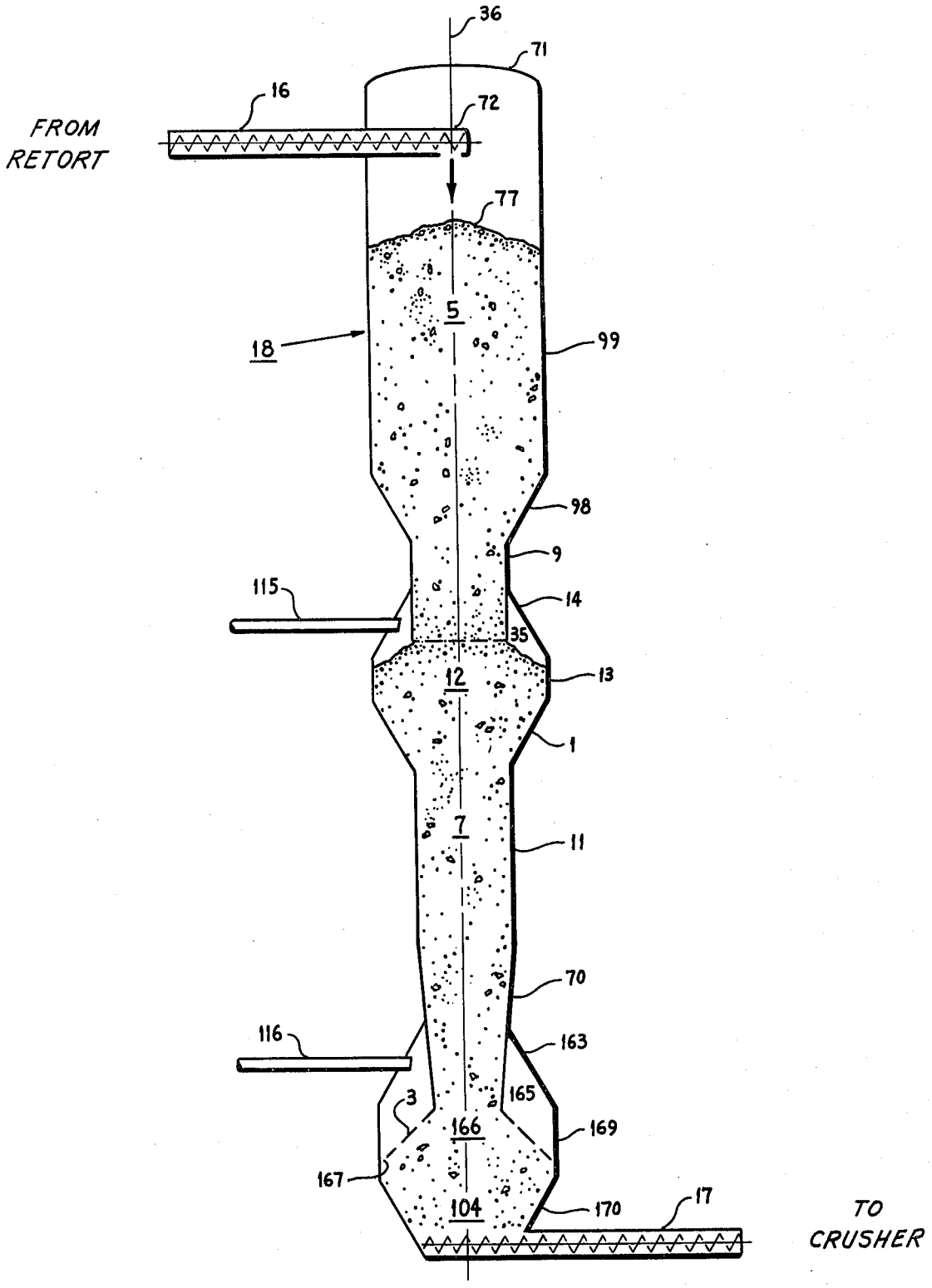
In FIG. 2 is shown the preferred embodiment of the sealing leg apparatus identified generally in FIG. 1 by reference numeral 18. All identical reference numerals in FIGS. 1 and 2 refer to the same items.

The sealing leg will be described in fuller detail hereinafter with reference to FIG. 2, but generally the function of the sealing leg is to isolate retort 8 from crusher 15, using a bed of descending retorted shale particles to induce appropriate pressure drop resistances to the flow of sealing gas introduced via conduit 115. In operation, the sealing gas, which may be steam or an inert gas, is directed into the upper portion of sealing leg 18 at a rate and pressure sufficient to overcome the pressure drop in the upper portion of the shale bed in the sealing leg and provide a positive pressure at the top thereof which somewhat exceeds the retort gas pressure, whereby a small portion (e.g., 10 percent or less, preferably 5 percent or less by volume) of the sealing gas leaks into the retort via conduit 16. The remainder of the sealing gas is not allowed to flow upwardly in the sealing leg and instead flows downwardly in co-current flow with the descending shale particles. Eventually, the bulk of the downward traveling sealing gases exits via conduit 116, but some will traverse the entire length of the seal leg and leak into crusher 15, which is preferably affixed in fluid-tight arrangement not only with sealing leg 18 via conduit 17 but also with gas lift 20 via conduit 33. However, due to the resistance to gas flow offered by that portion of the shale bed in the sealing leg below conduit 116, the amount of sealing gas which passes into crusher 15 is relatively small, usually being no more than 10 percent by volume of the sealing gas introduced through conduit 115, preferably less than 5 percent by volume.

In the preferred embodiment, the sealing gas introduced into sealing leg 18 is steam, for as it travels in co-current flow with the descending shale particles, the steam reacts with residual coke and sulfur components on the retorted shale particles to produce carbon monoxide, hydrogen, hydrocarbonaceous gases, and hydrogen sulfide. In this embodiment, therefore, a mixture of gases is recovered from the sealing leg comprised largely of water vapor but also containing carbon monoxide, hydrogen, hydrogen sulfide, and hydrocarbonaceous product gases. This mixture of gases may be sent via conduits 116 and 203 via valve 204 to a scrubber (not shown) for separation and recovery of the noncondensable gases, i.e., carbon monoxide, hydrogen, hydrocarbonaceous product gases, etc., with the remaining water component being delivered in either a vapor or liquid form to a steam generation system. Preferably, however, the gaseous mixture in conduit 116 is directed by conduit 201 and valve 202 and combined with the steam carried in steam line 120 for entry into gas lift 20.

Also recovered from sealing leg 18 are the retorted and steam-treated (if steam is employed in the sealing leg) shale particles, which particles are transported from the sealing leg by a screw conveyor within conduit 17 to crusher 15 at a relatively high temperature, usually above about 500° F. and preferably above about 800° F. In the crusher, the shale particles are reduced to a size usually no greater than ½ inch, and preferably to less than ¼ inch, and usually between about ⅛ and ¼ inch. The crusher itself may be any suitable device for reducing the size of particulate solids, preferably with a minimum of fines production. Typical crushers suitable for use herein include toothed roll crushers, jaw crushers, cone crushers, and hammer crushers, with the hammer variety being preferred for their usefulness in minimizing fines production and for their capacity relative to the size of the machine.

Particles recovered from crusher 15 gravitate into conduit 33 wherein a screw conveyor mechanism transports the particles from crusher 15 into gas lift 20. Upon entry into the gas lift, the crushed shale particles are swept aloft by air from blower 32 via conduits 200 and 159, heat exchanger 31, and conduits 168 and 117. The air enters the lift flowing upwards at a velocity and pressure sufficient to elevate the crushed shale particles to the entrance of a cyclone separator 21 or other means for separating gases from particulate solids. Generally, a gas velocity of about 20 to about 150 feet per second, and preferably about 50 to 100 feet per second, and a blower discharge pressure of about 2 to about 10 p.s.i.g., and preferably 4 to 5 p.s.i.g., are employed. Usually, the air feed is controlled by control valve 43 responsive to flow controller 67 so as to enter gas lift 20 at a rate between about 1,000 and about 1,500 SCF per ton of shale introduced into the gas lift.

If desired, a portion of the air supplied to gas lift 20 in conduit 117 may be replaced with either steam from conduit 120 flowing through control valve 42 responsive to flow controller 63 or with inert gas from conduit 125 flowing through control valve 38 responsive to flow controller 64. In yet another embodiment, a mixture of air, steam, and inert gas is utilized. In the preferred embodiment, however, the gas used to replace a portion of the air issuing from control valve 43 leading to gas lift 20 is only the gas mixture leaving sealing leg 18 via conduit 201. To this end, hand-operated valves 65 and 66 are closed while control valves 42 and 43 are open.

The gas-particulate mixture sweeping upwards in gas lift 20 gradually increases in temperature due to partial combustion of coke in the crushed retorted shale, usually under net reducing conditions wherein no more than 30 percent, and typically no more than 20 percent, of the air for combustion in conduit 168 is directed into the gas lift via conduit 117 while the remainder passes into combustor 26 via conduits 119 and 301. In the preferred embodiment of the invention, the gas lift temperature is controlled to a maximum selected value, usually between about 900° and 1600° F., as for example, 1000° F. The selected maximum gas lift temperature may be maintained using an appropriate temperature control scheme (not shown) wherein the air rate, inert gas rate, and steam rate are regulated by control valves 43, 38, and 42, respectively, in relation to the shale feed rate through conduit 33 so as to yield the desired maximum temperature at the top of gas lift line 20.

At the top of lift line 20, the crushed shale particles are separated from a gas stream in cyclone separator 21. The separated gas stream enters combustor 26 above the fluidized bed via conduit 118 while the crushed particles gravitate from the cyclone separator through chute 22 into the fluidized bed in combustor 26. In the preferred embodiment, the separated gas stream contains gaseous reaction products whose combustion will increase the thermal recovery and pollution control efficiencies of the overall process.

Because some sulfur components usually present in the retorted shale or in the coke contained therein are converted to one or more gaseous forms in gas lift 20, and because the preferred embodiment provides for introducing sulfur-containing gases (and particularly hydrogen sulfide) into gas lift 20 from sealing leg 18 via conduits 201, 120, and 117 and also via conduit 17, crusher 15, and conduit 33, sulfur-containing gases will generally be present in the separated gases recovered in conduit 118. These sulfur-containing gases, due to the net reducing combustion conditions preferably maintained in gas lift 20, will largely be present as hydrogen sulfide and sulfur dioxide, the latter forming either directly by combustion of gaseous sulfur components entering the gas lift or indirectly by combustion of sulfur-containing gases released from the shale particles in the gas lift. However, it should be noted that, during combustion in lift line 20 and gas separator 21, and more especially in combustor 26, sulfur-containing gases (and particularly the sulfur oxides) react with alkaline components of the retorted shale and remain therewith in a stable form so long as the operating temperature of the combustor is controlled as hereinafter described. Thus, although sulfur-containing gases are produced in the process of the invention, provision is made to remove essentially all of such components and thereby minimize sulfur emissions from the combustor while producing an environmentally safe, sulfur-containing shale ash.

Also contained in the separated gases in conduit 118 are fuel gases such as carbon monoxide, hydrogen, and hydrocarbonaceous gases, e.g., methane, ethane, and the like. Some of these gases are produced in sealing leg 18 and enter gas lift 20 via conduit 17, crusher 15, and conduit 33 and, if the preferred embodiment is employed, via conduits 201, 120, and 117. These fuels will usually be only partially consumed during combustion in the gas lift when net reducing conditions are employed. Since fuel gases may be released from the coke under net reducing conditions, the amount of fuel gases contained in the separated gas stream in conduit 118 may exceed that which entered the gas lift. In any event, the separated gas stream is preferably directed by conduit 118 to combustor 26 wherein any fuel gases are combusted to supply heat energy for the process of the invention while sulfur emissions are minimized as explained above.

In combustor 26, a fluidized combustion zone is maintained, the main purpose of which is to salvage heat energy from the coke still remaining in the shale particulates. Operating under fluidized combustion conditions allows for high combustion efficiency since the finely crushed particulates expose more coke than the larger-sized particulates recovered from the retort would and the high degree of turbulence maximizes the contacting efficiency between the coke in the crushed particulates and the gaseous oxygen required to support combustion. Yet another advantage of a fluidized combustor, since combustion efficiency is maximized, is that sulfur emissions during combustion are minimized.

Combustor 26 is preferably provided with a suitable vessel into which fuel sources such as raw shale fines, coal, or other crushed, particulate fuels may be introduced, as for example by means of screw conveyor 23. Other fuel sources are also provided for in the preferred embodiment, for example, fuel gas or fuel oil through conduit 148. Fuels from these sources are generally employed during start-up, but they may also be introduced if desired during normal operation. However, once normal operation (i.e., steady state) is achieved, the primary fuel in combustion vessel 26 will be the coke still remaining on the shale particulates introduced through chute 22.

Fluidized combustion conditions are achieved in the combustor by introducing air therein from blower 32 via conduits 200 and 159, heat exchanger 31, and conduits 168, 119, and 301 at a temperature (elevated by heat exchange in heater 31) and at a rate (controlled by operation of control valve 50 regulated by flow controller 62) so as to maintain combustion conditions and ensure fluidization of the largest particulates. Generally, these objectives are achieved by heating the air passing through heater 31 to a temperature between about 100° and about 800° F. by indirect heat exchange with flue gas and passing the air through the combustor at a linear velocity between about 2 and 15 feet per second, preferably between 3 and 6 feet per second and at a rate of about 10,000 to 20,000 SCF per ton, typically about 16,000 SCF per ton, of shale particulates carried in chute 22. Higher air rates may be necessary if fuel is also added via screw conveyor 23 or conduit 148.

Preferably, the combustion in combustor 26 is such as to derive the maximum amount of heat energy from the combustible materials introduced therein, the combustion usually being achieved under net oxidizing conditions with excess oxygen, preferably a minimum of excess oxygen (e.g., less than 1%, typically 0.1 to 0.2%) to minimize emissions of $NO_x$, for example, below 400 ppmv, and preferably below 300 ppmv. Typically, the combustion is at least sufficient to leave no more than 20% of the coke that was present on the shale when removed from retort 8 via conduit 16. Preferably, no more than 10% remains, and in the most preferred embodiment, no more than 5% remains.

Combustor 26 may be operated at any elevated temperature sufficient to promote combustion of coke on the crushed shale particles, but preferred operation is such that the peak temperature lies between about 1200° and about 1670° F., and most preferably between 1400° and 1650° F., as for example, 1550° F. Higher temperatures are generally avoided, because operation at temperatures in excess of about 1700° F. results in high level emissions of sulfur compounds from the combustor. On the other hand, combustion temperatures below about 1700° F., and particularly below about 1670° F., are such that gaseous sulfur components in combustor 26 will react essentially to completion with alkaline components in the particulate shale, and remain therewith.

To regulate the temperature in combustor 26 below a desired peak value, reliance is placed primarily on adjusting the air flow into the combustor as necessary using control valve 50, or more preferably by introducing via conduits 300 and 301 a flow of inert gas such as flue gas or steam by opening valve 302 on conduit 300 while controlling air flow to give minimum excess oxygen. However, advantage is also taken in combustor 26 of transferring heat to a steam generation system (shown only in relevant part in the drawing) using bed coils 44 and entrance and exit conduits 145 and 146. And in the event of overheating, water may be introduced directly into the combustor via conduit 121 using control valve 39 responsive to temperature controller 41 set at a predetermined maximum value, which value may, for example, be the maximum temperature desired in combustor 26 or the maximum safe operational temperature for combustor 26.

The hot flue gas produced in combustor 26 usually issues therefrom at a total flow rate generally between about 15,000 and about 35,000 SCF per ton, and typically about 22,000 SCF per ton, of shale introduced into combustor 26. Although this flue gas may be discharged from the combustor as a single flue gas stream followed by recovery of heat therefrom, in the practice of the present invention it is highly preferred that the flue gases be divided into two streams, from which heat recovery is accomplished for the threefold purposes of (1) controlling the temperature of the retorting gases in conduit 100, (2) aiding in the generation of steam by heating boiler water carried in conduit 127, and (3) preheating the air in conduit 159 for use subsequently in gas lift 20 via conduit 117 and combustor 26 via conduits 119 and 301. Thus, in the preferred practice of the invention, a first flue gas stream flows from combustor 26 into conduit 123 at a rate ultimately regulated by control valve 54 responsive to "split range" temperature controller 53, with the rate generally being at between about 12,000 and about 25,000 SCF per ton, and typically about 16,000 SCF per ton of shale introduced into combustor 26. This first stream enters and traverses heat exchanger vessel 24, flows therefrom by conduit 129 to cyclone separator 27 or other means for separating gases from particulate solids, and is recovered in conduit 134 to be combined with other flue gases in conduit 122. The resultant gases are then passed into heat exchanger 31 for transfer of as much heat as possible to air carried in conduit 159, after which they are discharged by conduits 205 and 153 either directly to atmosphere or indirectly after treatment in a dust removal system such as a bag house (not shown). The second flue gas stream leaves combustor 26 via conduit 126 at a rate ultimately regulated by control valve 55 responsive to the "split range" temperature controller 53, the rate generally being between about 3,000 and 10,000 SCF per ton, and typically about 6,000 SCF per ton of shale entering the combustor. This second flue gas stream in conduit 126 is blended in conduit 157 with yet other flue gases carried by conduit 158 from cooling vessel 30; the blended gases so produced are introduced into heat exchanger 25 through conduit 157. After traversing heat exchanger 25 and exchanging heat with boiler water in the steam generation system, which boiler water enters the exchanger by conduit 127 and exits by conduit 128, the combined flue gases are carried by conduit 130 into cyclone separator 28, from which they are recovered through conduit 135 in an essentially particulate-free condition (containing only dust) for use in heat exchanger 31.

In addition to salvaging as much heat energy as possible from the flue gases in heat exchangers 24, 25, and 31, provision is also made to control the retorting temperature in retort 8 using heat energy generated in combustor 26 and recovered in heat exchanger 24. For this purpose, a retort gas stream 103, which is usually a portion of the retort gases recovered from the retort in conduit 86, often after treatment for removal of sulfur compounds and/or removal of entrained fines and oil droplets, is passed through heat exchanger 24 and therein heated from an initial temperature usually in the range of about 140° to 200° F. to a desired retorting temperature, the heated retort gas then being directed by conduit 100 to retort 8. The temperature to which the retort gas stream is heated is regulated by control valve 54, which controls the rate at which flue gas passes through the shell side of heater 24. Control valve 54 in turn is responsive to "split range" temperature controller 53, which measures the retort gas temperature in conduit 100 relative to a set point and appropriately adjusts the respective rates at which flue gases pass through control valves 54 and 55, so that the retort gas temperature in conduit 100 is maintained as closely as possible to the set point. Typically, the retort gas temperature is controlled to a temperature between about 900° and about 1050° F., and usually to about 1000° F., and should the temperature control system fail and an excessive temperature condition be encountered quench water may be introduced into heater 24 via conduit 102 by opening hand-operated valve 90.

Also included in the preferred embodiment of the present invention is a system for collecting and treating fines carried from combustor 26 in the various flue gas streams. For this purpose a fines collection line 150 is provided to gather fines recovered from cyclone separators 27 and 28 via conduits 131 and 132, respectively. The fines collection line also gathers fines which gravitate directly thereinto from heat exchanger 24 and indirectly from heat exchanger 25 through conduit 149. Ultimately, therefore, all the fines produced in the process of the invention, save whatever residual portion in the form of dust is carried to the atmosphere or a bag house via conduit 153, are gathered in fines collection line 150.

The fines thus collected may be subjected to heat exchange, so as to recover as much energy as possible from the process. The heat exchange, of course, may be achieved through use of any of a number of heat exchange devices, such as rotary drum coolers, gravity coolers with indirect heat exchange and indirect screw coolers.

In the preferred practice, however, the heat energy in the fines is not recovered; instead, fines from collection line 150 are introduced into fines cooler 29 and therein cooled by evaporating water introduced directly onto the fines as a spray from distribution means 206, which draws water from conduit 37. Air is introduced into the fines cooler from conduits 200, 201, and 143 at a rate, regulated by control valve 208 responding to flow controller 209, sufficient to fluidize the fines within the fines cooler. Yet further enhancement is achieved by controlling the rate at which water is drawn through valve 207 on conduit 37 such that all water introduced into the fines cooler is vaporized therein and recovered as a vapor with other gases in conduit 151. Operating in this manner provides for recovery, through conduits 210 and 144 as regulated by control valve 211 responsive to level controller 212, of decarbonized shale fines in an essentially moisture-free form suitable for transport to a disposal site. The fines are wetted in a controlled manner before disposal in a landfill site.

Meanwhile, the water-containing gas stream recovered from the fines cooler in conduit 151 is transported to cyclone separator 40 and conduit 150 and combined with other gases in conduit 153 for bag house treatment or other means of dust removal. Also recovered from cyclone separator 40 are residual, decarbonized fines, which, being in an essentially moisture-free condition, are first collected in conduit 160 and then combined in conduit 144 with other particulates in a similar condition, after which the combined particulates are directed to a disposal site.

Returning now to combustor 26, provision is made in the invention for cooling and recovering heat from the residue shale ash. In the preferred embodiment, hot, decarbonized shale ash gravitates from combustor 26 through chute 34 into cooling vessel 30 for heat recovery and further combustion of coke, the rate of gravitation being controlled by control valve 61 in response to level controller 79, which establishes the requisite residence time for shale particles in the combustor. The bed of shale ash is maintained in a fluidized state by contact with a stream of air at ambient temperature entering from conduit 137 at a rate regulated by control valve 260 responsive to flow controller 261. In the upper regions of cooling vessel 30 the hot, fluidized particles generate steam through indirect heat exchange with circulating boiler water entering therein from conduit 138 and exiting via conduit 139. In the lower regions of cooling vessel 30, feedwater to a boiler of the steam generation system entering via conduit 140 and exiting via conduit 141 is preheated through heat exchange with the fluidized particles. As a result of heat recovery, the temperature of the shale ash drops from that in the combustor, usually about 1400° to 1700° F., to between about 300° and about 450° F. In the preferred embodiment, residence time in vessel 30 is sufficient to accomplish the above temperature drop while allowing for combustion of some or essentially all of the residual coke in the shale, usually between about 20 and about 40 minutes.

From the floor of cooling vessel 30, the shale ash empties by gravity through chute 19 into conduit 142, the rate of gravitation being controlled by control valve 51 in response to level controller 52. The cooled, decarbonized, essentially moisture-free ash in conduit 142 is combined with cooled shale fines from conduits 210 and 160, and the mixture is sent to disposal via conduit 144. A conventional system for controlled wetting (not shown) may form a part of the disposal system, for example, the decarbonized shale ash in conduit 144 may be sent through a pugmill and therein mixed with water so that it forms a cement.

In alternative embodiments, cooling and recovering heat from residue shale ash removed from the combustor may be accomplished by such equipment as rotary drum coolers, gravity coolers with indirect heat exchange, and indirect screw coolers.

The retorting process as above described offers several advantages, among which are maximum temperature control as well as minimum emissions of sulfur at all times, including start-up and shut-down. Retort temperature may be reduced to prevent excess cracking of product vapors and formation of clinkers by diverting a larger portion of the flue gases from combustor 26 to heat exchanger 25 for steam generation while reducing the flow to the recycle gas heater 24. Combustion temperature is decreased by sending into the combustor more fluidizing air, thereby safeguarding from thermal degradation the solid sulfur-containing products of combustion and, thus, minimizing sulfur emissions.

High efficiencies of heat recovery and combustion are additional features of this process. The heat recovery efficiency, which is often at least 50 percent, and usually in the range of about 50 to about 75 percent of the heat generated in the process, is combined with water requirements so minimal that the retorting process is feasible for use in areas where water is expensive or in short supply. High combustion efficiency, on the other hand, ensures maximum utilization of all the fuel in the shale while providing an essentially decarbonized and moisture-free shale ash that upon wetting spontaneously forms a permanently stable cement-like agglomerate suitable for revegetation in accordance with environmental regulation.

Yet another advantage of this process is that the shale is elevated to the combustor by means of a dilute-phase lift line. Bucket elevators or other mechanical lifting devices are not required.

Both the apparatus and method of operation of the sealing leg offer particular advantages in this invention, as may be seen from the following more detailed description. The preferred embodiment of the sealing leg apparatus is shown in FIG. 2 of the drawing, and as depicted therein, the apparatus includes an elongated fluid-tight sealing leg vessel shown generally at 18, having center axis 36, and is adapted to receive, pass, and discharge a gravitating bed of retorted oil shale particles, preferably in mass-type (plug-flow) fashion. The sealing leg vessel 18 comprises a surge chamber 5, a gas injection chamber 12, a sealing leg chamber 7, and a gas disengaging chamber 166.

The uppermost portion of vessel 18 contains surge chamber 5, which is comprised of first vertical cylinder 99 enclosed at the top in a fluid-tight jointure with surge chamber roof 71. The surge chamber is adapted to receive a gravitating particle bed of retorted oil shale from retort 8 by means of a screw conveyor in conduit 16, which conduit extends into cylinder 99 and terminates at opening 72 within surge chamber 5 near center axis 36. Cylinder 99 is sufficiently long to provide a desired residence time in the surge chamber for the gravitating particle bed, typically between about 2 and about 15 minutes.

Immediately below cylinder 99 and mated thereto in a fluid-tight bond is a downwardly converging, first truncated cone 98, the larger end of which is of substantially the same diameter as cylinder 99. The smaller end of truncated cone 98 is of substantially the same diameter as second vertical cylinder 9, positioned immediately below the truncated cone 98, and attached therewith coaxially in a fluid-tight bond. The diameter of cylinder 9 is, in the most preferred embodiment of the invention, the same as that of cylinder 11 to be described hereinafter, and the length of cylinder 9 is such as to extend a substantial distance into gas injection chamber 12.

Gas injection chamber 12, which is adapted for injection of gas into the body of the gravitating particle bed, is preferably comprised of third vertical cylinder 13 joined coaxially in fluid-tight fashion at its top to second truncated cone 14 and at its bottom to third truncated cone 1. Truncated cone 14 joins the exterior of cylinder 9 coaxially in fluid-tight arrangement and diverges downwardly therefrom connecting with cylinder 13 in a plane wherein the cross-sectional diameter of cone 14 is equal to that of cylinder 13. Downwardly converging truncated cone 1, on the other hand, converges at an angle of between about 15° and 20° with respect to the vertical, and more preferably about 20°, connecting coaxially in fluid-tight fashion with both cylinders 13 and 11 in planes wherein the cross-sectional diameters of the cylinders equal that of the truncated cone 1. The smaller end of downwardly converging truncated cone 1 is joined coaxially in a fluid-tight bond to the top of cylinder 11.

Within gas injection chamber 12, void toroidal section 35 is formed by the outside of cylinder 9, second truncated cone 14, third cylinder 13, and the face of the gravitating particle bed at its natural angle of repose, which in the preferred embodiment extends to and touches cylinder 13. In the preferred embodiment, the sides of cylinder 13 extend downward from their jointure with second truncated cone 14 for a distance sufficient to assure that the particle bed contacts the inside surface of cylinder 13. Gas injection chamber 12 is adapted to receive a stream of pressurized gas via conduit 115 into void toroidal section 35, the volume of which section is large enough for the pressurized gas to penetrate into the particle bed in a relatively even distribution.

Below gas injection chamber 12 is sealing leg chamber 7, which is defined by fourth vertical cylinder 11 and fourth truncated cone 70 attached to said cylinder in coaxial, fluid-tight arrangement. Cylinder 11 is sufficiently long and sufficiently narrow that when filled with the gravitating particle bed a substantial resistance to gas flow is created therethrough. Typically, cylinder 11 has a length-to-cross-sectional area ratio of at least about 3 feet per square foot and often provides for a 15 p.s.i. differential between the gas pressures at the top and the bottom of seal leg chamber 7. In the preferred embodiment, the fourth truncated cone 70 tapers inwards from top to bottom, thereby reducing the pressure within the gravita- ting particle bed therebelow. The length of the tapered portion is generally between about 6 inches and about 3 feet, and the angle of the taper is between about 4° and about 6° with respect to the vertical.

Affixed immediately below seal leg chamber 7 is gas disengaging chamber 166 adapted to remove gas from the gravitating particle bed. The preferred disengaging chamber includes a downwardly diverging truncated cone adapted with slots or other openings to allow the passage of gas while substantially preventing the passage of solids. Such a truncated cone is shown on the drawing as fifth truncated cone 3, the smaller end of which joins fourth truncated cone 70 in a coaxial, fluid-tight bond in a plane wherein the cross-sectional diameters are equivalent. It is preferred that the slotted sides of fifth truncated cone 3 diverge at an angle just slightly steeper than that of the natural angle of repose of the moving particle bed, so that contact is always maintained between the bed and the slotted sides, thereby maintaining a stable gas disengaging particle surface. A diverging angle between about 20° and about 40° with respect to the vertical is preferable. The total void area available for gas to escape from the particle bed (in the preferred embodiment, the aggregate area of the slots in diverging truncated cone 3) is large enough to minimize the velocity of the escaping gas, thereby minimizing the quantity of fines entrainment. Escaping gas velocities through the slots of less than about 5 ft/sec are preferred, and velocities between about 2 and about 4 ft/sec are most preferred.

Outside of the slotted walls of truncated cone 3 but within the exterior walls of vessel 18 is enclosed a gas collecting chamber 165. Preferably, gas collecting chamber 165 is a toroidal enclosure formed by fourth truncated cone 70, fifth truncated cone 3, fifth cylinder 169 and annulus covering ring 163. Communicating with gas collecting chamber 165 is conduit 116, which, as shown in FIG. 1, is utilized to transfer gases from vessel 18 either to conduit 203 and thence to facilities for separation of condensable from noncondensable gases or to conduit 201 and steam line 120 for use in gas lift 20.

Cylinder 169 is slightly larger in diameter than the largest diameter of truncated cone 3 so as to form annular opening 167 between truncated cone 3 and cylinder 169. Annular opening 167 prevents buildup of fines within gas collecting chamber 165 by providing a passageway for fines to gravitate out of chamber 165 and back into the moving oil shale particle bed. Fifth cylinder 169 is coaxially affixed in fluid-tight fashion to truncated cone 70 by annulus covering ring 163. Annulus covering ring 163, in the form of a sixth truncated cone, is coaxially aligned along axis 36 with cylinder 169 and truncated cone 70 and has a larger end and a smaller end. The larger end is the same diameter as the upper end of cylinder 169 and is coaxially and fluid-tightly mated thereto. The smaller end has substantially the same diameter as the external diameter of truncated cone 70 at the plane of jointure, and is coaxially and fluid-tightly mated thereto. The sides of fifth cylinder 169 extend downwardly below fifth truncated cone 3 for a distance sufficiently long to assure that the particle bed gravitates along the entire underside of truncated cone 3 thereby continuing to maintain a stable gas disengaging particle surface within gas disengaging compartment 166. Affixed in a fluid-tight bond to the bottom of cylinder 169 at a distance usually about 3 feet above its bottom opening is the larger end of downwardly converging truncated cone 170. The sides of truncated cone 170 converge at an angle of about 17° with respect to the vertical. The smaller end of truncated cone 170 is attached in a fluid-tight bond to conduit 17 containing a screw conveyor for transporting shale particles to crusher 15.

In operation, retorted oil shale particles are fed from retort 8 into surge chamber 5 of vessel 18 via conduit 16, flowing out of opening 72 and forming a gravitating particle bed within surge chamber 5. From surge chamber 5, the gravitating particle bed passes through cylinder 9 into gas injection chamber 12. A stream of inert sealing gas (e.g., nitrogen) flows into the void of toroidal section 35 via conduit 115 at a rate and pressure sufficient to maintain enough positive pressure to exclude retort recycle gas from entry into sealing leg 18. In the preferred embodiment steam, at a rate controlled by control valve 75 (on FIG. 1) responding to differential pressure controller 76 and sufficient to maintain a positive pressure difference of about 0.15 p.s.i.a. between toroidal section 35 and conduit 16, replaces inert gas as the sealing gas. During passage through sealing leg 18, steam reacts with some of the coke on the hot retorted shale to produce hydrogen, hydrogen sulfide, carbon monoxide, and other hydrocarbonaceous gases, which mingle with the steam flowing through the particle bed contained within vessel 18.

Sealing gas introduced through conduit 115 fills the void toroidal section 35, permeates the bed of shale particulates in gas injection chamber 12, and from there flows in two directions. A minor portion, usually less than about 10 percent by volume, preferably less than 5 percent by volume, of the gas introduced from conduit 115 travels upwardly in countercurrent flow to the descending shale particles, traversing cylinder 9 and surge chamber 5 and ultimately exiting via conduit 16 into retort 8. The remainder of the gas flows downwardly in co-current flow with shale particles through gas injection chamber 12 and seal leg chamber 7 and thence into gas disengaging chamber 166, from which the bulk of the sealing gases introduced into vessel 18 via conduit 115 are recovered by passage first through slotted truncated cone 3, then through gas collecting chamber 165 and finally through conduit 116, to be treated thereafter in accordance with the description hereinbefore given with respect to FIG. 1 of the drawing.

Not all of the gases flowing into gas disengaging chamber 166, however, are recovered via conduit 116; a small proportion, generally less than 10 percent by volume, preferably less than 5 percent by volume, of the gas introduced through conduit 115, passes into crusher 15 via conduit 17. Thus, in operation, a minor percentage of the total gases introduced through conduit 115 exits via conduit 16 into retort 8 and via conduit 17 into crusher 15, and in this manner, not only are the gases in both the retort and the crusher kept separate from each other, but the shale particulates are recovered from retort 8 without loss of retort product gas produced therein.

It should also be noted that gas pressure within and rate of flow through conduit 115 into seal leg vessel 18 depend not only upon the pressures prevailing in retort 8 and in crusher 15 but also upon resistance to gas flow imposed by the moving particle bed contained in the sealing leg. Ideally, flow rates of gas from sealing leg vessel 18 into retort 8 and crusher 15 are minimized to a trickle and recovery of sealing gas via conduit 116 is maximized by resistance to gas flow imposed by the moving shale bed. In the preferred embodiment, the bed of gravitating shale provides a pressure drop reducing the inlet gas pressure in conduit 115 to only slightly greater than the retort pressure at the top of surge chamber 5, while pressure at the bottom of gas disengaging zone 166 is only slightly greater than that in crusher 15, generally about 0 to 10 p.s.i.g.

The shale particulates are also drawn into crusher 15 from the sealing leg after passing through bottom opening 104 and being transported through conduit 17 by a screw conveyor, as for example, a variable-speed motor-driven screw conveyor. Other means of solids transport may replace the screw conveyor in conduit 17, as well as other screw conveyors hereinbefore mentioned. In the preferred embodiment, the screw conveyor in conduit 17 feeds particulate solids into crusher 15 at a rate regulated by solids level controller 105 (on FIG. 1) to maintain a desired solids level 77 in surge chamber 5.

The sealing leg apparatus and process for its use as above described provide significant advantages. Unlike wet seals, which quench shale, leaving it wet and considerably cooled, the dry sealing leg transports shale in a hot, dry condition. When used in a retorting process utilizing a combustor to recover heat energy from retorted shale, the sealing leg requires no additional expense of heat to dry or reheat shale to combustion temperature. Compared to wet seal operation, use of the dry sealing leg improves heat recovery efficiency. Additionally, unlike conventional devices for regulating gas-solids flow such as star locks or valves, the sealing leg has no moving parts to cause erosive wear by the relatively large-sized shale particulates. In a retorting process utilizing a fluidized bed combustor, retorted shale must be crushed in advance of delivery to the combustor. Employing the dry sealing leg in such a retorting process offers the most particular advantage of delivering shale from a retort operating at a superatmospheric pressure to a conventional crusher operating at or near atmospheric pressure without loss of valuable retort gases.

Although this invention has been described in conjunction with a preferred embodiment thereof, it is evident that many alternatives, modifications, and variations will be apparent to those skilled in the art in light of the foregoing description. For example, a variety of hydrocarbon-bearing particulates may be used in the process of the invention, including coal and lignite. Accordingly, it is intended to embrace this and all such alternatives, modifications, and variations that fall within the spirit and scope of the appended claims.

I claim:

1. A process for recovering heat energy from retorted shale particulates of a size suitable for fluidization, said shale particulates containing combustible materials and being of a size suitable for fluidization, which process comprises:

(1) combusting a substantial proportion of the combustible material contained within said shale particulates in a fluidized bed combustion zone, the particulates being maintained in a fluidizing condition by a first fluidizing gas stream comprising oxygen introduced into said combustion zone at a rate sufficient to fluidize the largest of the particulates introduced therein;

(2) recovering flue gases from said fluidized bed combustion zone and dividing said flue gases into a first and second flue gas stream;

(3) heating a stream of eduction gases used in a retorting zone to retort hydrocarbon-bearing particulates by indirect heat exchange with the first flue gas stream recovered in step (2);

(4) heating water by indirect heat exchange with the second flue gas stream recovered in step (2);

(5) regulating the temperature in said retorting zone by changing the flow rate of said flue gases recovered from step (1) used to heat water in step (4) and correspondingly changing the flow rate of said flue gases in step (3) used to heat said stream of eduction gases;

(6) heating water by indirect heat exchange with shale particulates recovered in step 2 in a fluidized cooling zone, the shale particulates being maintained in a fluidizing condition by a second fluidizing gas stream introduced into said cooling zone at a rate sufficient to fluidize the largest of the particulates contained therein;

(7) recovering heat from gases recovered from said fluidized cooling zone; and (8) heating said first fluidizing gas stream by heat exchange with residual heat contained in said first and second flue gas streams after recovery thereof from steps (3) and (4).

2. A process as defined in claim 1 comprising recovering heat in step (7) by heat exchange with water.

3. A process as defined in claim 2 wherein the shale particulates undergo substantial cooling in said fluidized cooling zone.

4. A process as defined in claim 2 wherein heat is further recovered in step (7) by heating said first fluidizing gas stream.

5. A process as defined in claim 4 wherein the shale particulates undergo substantial cooling in said fluidized cooling zone.

6. A process as defined in claim 1 comprising recovering heat in step (7) by heating said first fluidizing gas stream with gases recovered from said fluidized cooling zone.

7. A process as defined in claim 6 wherein the shale particulates undergo substantial cooling in said fluidized cooling zone.

8. A process as defined in claim 1 wherein the heat exchange in step (8) is accomplished with a commingled gas stream comprising said first and second flue gas stream and gases from said fluidized cooling zone.

9. A process as defined in claim 8 wherein the shale particulates undergo substantial cooling in said fluidized cooling zone.

10. A process as defined in claim 1 wherein the shale particulates in step (6) undergo substantial cooling in said fluidized cooling zone.

11. A process for recovering heat energy from retorted shale particulates containing combustible materials and being of a size suitable for fluidization, which process comprises:

(1) combusting a substantial proportion of the combustible material contained within said particulates in a fluidized bed combustion zone, the crushed particulates being maintained in a fluidizing condition by a first fluidizing gas stream comprising excess oxygen introduced into said combustion zone at a rate sufficient to fluidize the largest of the particulates introduced therein;

(2) recovering flue gases from said fluidized bed combustion zone and dividing said flue gases into a first second flue gas stream;

(3) heating a stream of eduction gases used to retort hydrocarbon-bearing particulates in a retorting zone by indirect heat exchange with the first flue gas stream recovered in step (2);

(4) heating water by indirect heat exchange with shale particulates recovered from step (1) in a fluidized cooling zone, the shale particulates being maintained in a fluidizing condition by a second fluidizing gas stream comprising oxygen introduced into said cooling zone at a rate sufficient to fluidize the largest of the particulates contained therein;

(5) heating water with said second flue gas stream recovered in step (2) and with gases obtained from said fluidized cooling zone;

(6) regulating the temperature in said retorting zone by changing the flow rate of said flue gases recovered in step (2) used to heat water in step (5) and correspondingly changing the flow rate of said flue gases used to heat said stream of eduction gases in step (3);

(7) heating said first fluidizing gas stream by heat exchange with residual heat contained in gases recovered from steps (3) and (5); and (8) cooling entrained fines recovered from the gas streams utilized in steps (3) and (5).

12. A process for recovering heat energy from retorted shale particulates as defined by claim 11 wherein said particulates also contain sulfur components and components capable of reacting with gaseous sulfur components to produce stable solid sulfur-containing materials and wherein a flue gas of relatively low sulfur content is produced when temperature in said fluidized combustion zone is regulated at a sufficient level by heat exchange with water in conjunction with controlling the proportion of oxygen contained in said first fluidizing gas stream.

13. A process for recovering heat energy from retorted shale particulates as defined by claim 12 wherein the temperature in said fluidized combustion zone is maintained below 1670° F.

14. A process as defined in claim 13 wherein the shale particulates undergo substantial cooling in said fluidized cooling zone.

15. A process for recovering heat energy from retorted shale particulates as defined by claim 11 wherein shale particulates discharged from said fluidized cooling zone are essentially completely decarbonized.

16. A process as defined in claim 15 wherein the shale particulates recovered from said fluidized cooling zone have been substantially cooled.

17. A process for recovering heat energy from retorted shale particulates as defined by claim 11 wherein the fines recovered from the gas streams utilized in steps (3) and (4) are cooled with only sufficient water to quench the fines without leaving them in a wet condition.

18. A process for recovering heat energy from retorted shale particulates as defined by claim 11 wherein heat energy is recovered from the shale particulates in said fluidized bed combustion zone by indirectly heating water therein.

19. A process for recovering heat energy from retorted shale particulates as defined by claim 11 wherein the temperature of shale particulates entering the fluidized bed combustion zone is between about 900° and 1600° F., the temperature of the shale particulates entering the fluidized cooling zone is between about 1400° and about 1700° F., the temperature of the shale particulates leaving the fluidized cooling zone is between about 300° and about 450° F., the temperature of the first fluidizing gas stream in step (7) is raised to between about 300° and about 450° F., and the temperature of the eduction gases after heat exchange in step (3) is raised to between about 900° and about 1200° F.

20. A process as defined in claim 11 wherein the shale particulates in step (4) undergo substantial cooling in said fluidized cooling zone.

21. A process as defined in claim 11 wherein the heating of water in step (5) is accomplished with a first commingled gas stream comprising said second flue gas stream recovered from step (2) and gases from said fluidized cooling zone.

22. A process as defined in claim 21 wherein the shale particulates undergo substantial cooling in said fluidized cooling zone.

23. A process as defined in claim: 21 wherein the heat exchange in step (7) is accomplished with a second commingled gas stream comprising the first commingled gas stream plus gases recovered from step (3).

24. A process as defined in claim 23 wherein the shale particulates undergo substantial cooling in said fluidization zone.

25. A process for recovering heat energy from retorted shale particulates containing hydrocarbonaceous materials and being of a size suitable for fluidization, said particulates further containing sulfur components and components capable of reacting with gaseous sulfur components to produce stable solid sulfur-containing materials in step (1) hereinafter, which process comprises:

(1) combusting a substantial proportion but not all of the hydrocarbonaceous material contained within said retorted shale particulates in a fluidized bed combustion zone at a temperature sufficient to produce a flue gas of relatively low sulfur content, the crushed particulates being maintained in a fluidizing condition by a first fluidizing gas stream comprising minimum excess oxygen introduced into said combustion zone at a rate sufficient to fluidize the largest of the particulates introduced therein, said temperature being regulated to less than 1670° F. by indirect heat exchange with water in conjunction with control of the proportion of oxygen contained in said first fluidizing gas stream;

(2) recovering flue gases from said fluidized bed combustion zone and dividing said flue gases into a first and second flue gases stream;

(3) heating a stream of retort eduction gases, comprised of uncondensable gases produced by retorting shale particulates in a retort for obtaining hydrocarbonaceous vapors from hydrocarbon-bearing particulates, by indirect heat exchange with the first flue gas stream recovered in step (2) to a temperature between about 900° and about 1200° F.;

(4) heating water by indirect heat exchange with shale particulates recovered from step (1) in a fluidized cooling zone, the shale particulates being maintained in a fluidizing condition by a second fluidizing gas stream comprising oxygen introduced therein at a rate sufficient to fluidize the largest of the particulates contained therein, said shale particulates entering said fluidized cooling zone at a temperature between about 1400° and 1700° F. and leaving said fluidized cooling zone at a temperature between about 300° and about 450° F.;

(5) discharging from said fluidized cooling zone essentially completely decarbonized shale particulates;

(6) heating water by heat exchange with heat contained in said second flue gas stream recovered from step (2) and in gases recovered from said fluidized cooling zone;

(7) heating said first fluidizing gas stream to a temperature between about 300° and about 450° F. by heat exchange with residual heat contained in gases recovered from steps (3) and (6);

(8) regulating the temperature of said retort eduction gases by changing the flow rate of said flue gases recovered from step (1) used to heat water in step (6) and correspondingly changing the flow rate of said flue gases used to heat said stream of eduction gases in step (3);

(9) cooling entrained fines recovered from gases utilized in steps (3) and (6) with only sufficient water so as to quench the fines without leaving them in a wet condition; and

(10) recovering heat energy from said fluidized bed combustion zone by indirectly heating water therein.

26. A process for retorting particulates containing hydrocarbon materials educible therefrom by retorting, which process comprises:

(1) introducing said particulates into a retorting zone wherein, at a temperature elevated above about 600° F., hydrocarbonaceous vapors are educed from said particulates, but said particulates still contain combustible materials;

(2) removing said particulates containing combustible materials from the retorting zone at a temperature above about 600° F. and introducing them into a sealing system wherein said particulates are passed serially through four zones, wherein:

(i) in the first zone, the particulates pass countercurrently to a first portion of sealing gas from the second zone, said first portion passing out of the first zone and into the retorting zone;

(ii) in the second zone, sealing gas is introduced into the particulates and split into at least a first and a second portion, the first portion passing countercurrently to the particulates, and the second portion passing co-currently with the particulates out of the second zone and into a third zone;

(iii) in the third zone, the second portion of sealing gas passes co-currently with the particulates while effecting a substantial pressure drop before entry together into a fourth zone;

(iv) in the fourth zone, sealing gas is separated from the particulates and removed from the sealing system;

(3) crushing particulates removed from said sealing system in a crushing zone to a size suitable for combustion under fluidizing conditions in step (5) hereinafter;

(4) transporting crushed particulates from step (3) to a fluidized combustion zone using a carrier gas stream fed at a rate sufficient to transport the largest of said crushed particulates;

(5) combusting a substantial proportion of the combustible material contained within said particulates in a fluidized bed combustion zone, the particulates being maintained in a fluidizing condition by a first fluidizing gas stream comprising oxygen introduced into said combustion zone at a rate sufficient to fluidize the largest of the particulates introduced therein;

(6) recovering a first and a second flue gas stream from said fluidized bed combustion zone;

(7) heating a stream of eduction gases used to retort hydrocarbon-bearing particulates by indirect heat exchange with the first flue gas stream recovered in step (6);

(8) heating water by indirect heat exchange with the second flue gas stream recovered in step (6) and gases recovered from the fluidized cooling zone of step (10) hereinafter;

(9) regulating the temperature in said retorting zone by changing the flow rate of said flue gases recovered from step (5) used to heat water in step (8) and correspondingly changing the flow rate of said flue gases used to heat said stream of eduction gases in step (7);

(10) heating water by indirect heat exchange with shale particulates recovered from step (5) in a fluidized cooling zone, the shale particulates being maintained in a fluidizing condition by a second fluidizing gas stream introduced into said cooling zone at a rate sufficient to fluidize the largest of the particulates contained therein; and

(11) heating said first fluidizing gas stream by heat exchange with residual heat contained in gases recovered from steps (7) and (8).

27. A process as defined in claim 26 wherein the shale particulates undergo substantial cooling in step (10) in said fluidized cooling zone.

28. A process for retorting shale particulates containing hydrocarbonaceous materials educible therefrom by retorting, said particulates further containing sulfur components and alkaline components capable of reacting with gaseous sulfur components in step (5) hereinafter to produce thermally stable, solid sulfur-containing materials, which process comprises:

(1) introducing said particulates into a retorting zone wherein, at a temperature elevated above about 600° F., hydrocarbonaceous vapors are educed from said particulates, but said shale particulates still contain combustible materials;

(2) removing said particulates containing combustible materials from the retorting zone at temperature above about 600° F. and introducing them into a sealing vessel wherein the they are passed serially through four vertically aligned zones, wherein:

(i) in the first zone, said shale particulates gravitate countercurrently to a first portion of sealing gas introduced into the second zone, said first portion passing upwardly out of the first zone and into the retorting zone;

(ii) in the second zone, sealing gas is introduced into the gravitating shale particulates and split into at least a first and a second portion, the first portion passing upwards countercurrently to the gravitating shale particulates into the first zone, and the second portion passing co-currently with the gravitating shale particulates out of the second zone and into a third zone;

(iii) in the third zone, the second portion of sealing gas passes co-currently with the shale particulates through the third zone while effecting a substantial pressure drop before entry together into a fourth zone;

(iv) in the fourth zone, sealing gas is separated from the gravitating shale particulates and is removed from the sealing vessel while the shale particulates gravitate out of the fourth zone and are removed from the sealing system;

(3) crushing shale particulates removed from said sealing vessel in a crushing zone to a size suitable for combustion under fluidizing conditions in step (5) hereinafter;

(4) transporting crushed shale particulates from step (3) to a fluidized combustion zone using a carrier gas stream fed at a rate sufficient to transport the largest of the crushed shale particulates;

(5) combusting a substantial proportion but not all of the hydrocarbonaceous material contained within said shale particulates in a fluidized bed combustion zone at a temperature sufficient to produce a flue gas of relatively low sulfur content, the crushed particulates being maintained in a fluidizing condition by a first fluidizing gas stream comprising minimum excess oxygen introduced into said combustion zone at a rate sufficient to fluidize the largest of the particulates introduced therein, said temperature being regulated to less than 1670° F. by indirect heat exchange with water in conjunction with control of the proportion of oxygen contained in said first fluidizing gas stream;

(6) recovering a first and a second flue gas stream from said fluidized bed combustion zone;

(7) heating a stream of eduction gases comprised of uncondensable hydrocarbonaceous gases produced by retorting said shale particulates in said retorting zone, said heating being accomplished by indirect heat exchange with the first flue gas stream recovered in step (6) to a temperature between about 900° and about 1200° F.;

(8) heating water by indirect heat exchange with shale particulates recovered from step (5) in a fluidized cooling zone, the shale particulates being maintained in a fluidizing condition by a second fluidizing gas stream comprising oxygen introduced therein at a rate sufficient to fluidize the largest of the particulates contained therein, said shale particulates entering said fluidized cooling zone at a temperature between about 1400° and 1700° F. and leaving said fluidized cooling zone at a temperature between about 300° and about 450° F.;

(9) discharging from said fluidized cooling zone essentially completely decarbonized shale particulates;

(10) heating water by heat exchange with a first mingled gas stream comprising the second flue gas stream recovered in step (6) and with gases obtained from said fluidized cooling zone;

(11) heating said first fluidizing gas stream to a temperature between about 300° and about 450° F. by heat exchange with residual heat contained in a second mingled gas stream comprising the first mingled gas stream recovered from step (10) and the first flue gas stream from step (7);

(12) regulating the temperature in said retorting zone by increasing or decreasing the flow rate of said flue gas used to heat water in step (10) and correspondingly increasing or decreasing the flow rate of said flue gas used to heat said stream of eduction gases in step (7);

(13) cooling entrained fines recovered from the gas streams utilized in steps (7) and (10) with only sufficient water so as to quench the fines without leaving them in a wet condition; and

(14) mixing said decarbonized shale particles of step (9) in a mixing zone with an amount of water sufficient to form a cement-like composition.

* * * * *